United States Patent [19]

Sasena et al.

[11] 3,969,090

[45] July 13, 1976

[54] INDUSTRIAL BRUSH

[75] Inventors: Robert C. Sasena, Irwin, Pa.; Roger E. Priest, Holden, Mass.

[73] Assignee: Anderson Corporation, Worcester, Mass.

[22] Filed: June 22, 1973

[21] Appl. No.: 372,597

[52] U.S. Cl. ..... 51/400; 15/159 A; 15/198

[51] Int. Cl.[2] ..... B24D 11/00; A46B 13/00; A46D 1/00

[58] Field of Search ..... 51/334, 400, 403, 404; 15/159 A, 198

[56] References Cited

UNITED STATES PATENTS

| | | | |
|---|---|---|---|
| 328,004 | 10/1885 | Church | 51/404 X |
| 2,328,998 | 9/1943 | Radford | 15/159 A |
| 2,401,956 | 6/1946 | Overbeke | 15/159 A |
| 2,609,642 | 9/1952 | Peterson | 51/403 |
| 2,825,914 | 3/1958 | Moss | 15/118 X |
| 3,118,161 | 1/1964 | Cramton | 15/159 A |
| 3,150,470 | 9/1964 | Barron | 51/400 |
| 3,583,020 | 6/1971 | Bateman | 15/198 |
| 3,618,609 | 11/1971 | Glick | 15/159 A |

*Primary Examiner*—Al Lawrence Smith
*Assistant Examiner*—Nicholas P. Godici
*Attorney, Agent, or Firm*—Norman S. Blodgett; Gerry A. Blodgett

[57] ABSTRACT

An industrial brush having a base adapted to be mounted for rotation and having a plurality of strands extending from the base, each strand consisting of a tube braided from filaments of synthetic resin.

6 Claims, 6 Drawing Figures

INDUSTRIAL BRUSH

BACKGROUND OF THE INVENTION

In certain industrial polishing and cleaning operations, it has been common practice to use a rotary brush whose filaments are impregnated with a polishing fluid, the fluid usually consisting of a liquid carrying fine particles of abrasive. The brushes usually used to have bristles made of a natural fiber. The most common fiber used is tampico which has sufficient porosity to carry the polishing compound, while at the same time, when suitably treated, having sufficient stiffness to drive the abrasive against the article to be polished with sufficient force. The supply of such natural fiber, however, is not only limited, but seems to be decreasing. For that reason, manufacturers of industrial brushes have sought a substitute material for the bristles.

One porous form of industrial brush filament is produced by twisting a fine wire. Such a brush is shown in the U.S. patent to Batemen U.S. Pat. No. 3,583,020. Such filaments of twisted wire (and even similar filaments made by twisting wire together in groups) have sufficient stiffness but they lack any ability to hold the grinding compound. It has also been suggested, for instance, in the patent of Overbeke U.S. Pat. No. 2,401,956 that the filaments be in the form of a cord braided from a natural fiber such as cotton. In order to prevent the filaments from being limp, the braid may be impregnated with a glue which hardens and provides some stiffness. It has been found, however, that such filaments wear quite readily and, furthermore, the impregnation of the pores in the braided cord leaves no porosity for the absorption of polishing compound. Furthermore, there is a tendency for the glue to break down in a short time and to leave the filaments too limp to provide the necessary polishing forces. These and other difficulties experienced with the prior art devices have been obviated in a novel manner by the present invention.

It is, therefore, an outstanding object of the invention to provide an industrial brush adapted in polishing and cleaning operations to take the place of brushes whose filaments are formed of natural fibers, such as tampico.

Another object of this invention is the provision of an industrial brush of the rotary type having filaments formed of readily-obtainable artificial materials.

A further object of the present invention is the provision for use with a polishing slurry (or other media) of an industrial brush whose filament are formed of synthetic fibers.

It is another object of the instant invention to provide an industrial rotary brush having filaments formed of synthetic resin and having a high degree of stiffness, but which is capable of absorbing and holding polishing and cleaning compounds in the interstices formed by a braided configuration.

A still further object of the invention is the provision of an industrial rotary brush having a filament with an artificial resin core in which abrasive particles are embedded and an outer layer of a tough porous material formed from an artificial resin.

It is a further object of the invention to provide an industrial brush having a filament with a solid inner core of sacrificial material containing abrasive particles and a porous outer layer of a tough wear-resistant material.

Another object of the invention is the provision of an industrial brush in which the physical action of the filaments can be regulated and controlled by virtue of the braided construction; in which braided monofilaments are used to reduce the areas of stress concentration, thus eliminating a primary cause of long filament breakage; in which braided monofilaments are used to preclude compacting of the face of the brush into a narrow face (knifing) at the periphery; in which strands of braided filaments act as a family of filaments, thus providing a density at periphery so distributed as to provide equal filament contact with all surfaces and all protuberances on such surfaces that are being brushed; in which braided strand configuration is provided, so that filament deflection can be controlled; in which large amounts of filaments give stiffness, but because of the braided tuft configuration, the brush gives many more cutting points; in which large monofilaments give stiffness, but, because of the braided strand configuration, individual monofilaments are not subjected to excessive concentration of stresses and consequently fatigue life is improved; in which the braids of the monofilament are related to each other in such manner as to permit them to mutually support each other, so that the increased number of monofilaments attainable at periphery permits longer life of the brush; in which braided tuft construction provides an action that is intermediate to the harsh impact action of the conventional knot or tufted brush, and the more uniform softness of conventional crimped wire brushes, while at the same time having a marked reduction in breakage; in which is obtained a unique value for brushing resilient materials so that unusually long life can be attained when brushing such materials as rubber, leather, plastic, etc., which normally cause reduced fatigue life; in which is obtained a braided tuft rotary brush of small diameter that is denser than is possible in brushes of other tuft construction, even where their tufts are placed as closely together as possible at the hub which leaves insufficient density at the periphery; in which braided tuft configuration permits simple and relatively inexpensive assembly techniques to be used; in which braided strands permit their being secured firmly against longitudinal movement; in which braided strands of monofilament are crimped to provide a damping effect by interengagement of the tufts of filament with each other at fixed intervals along their length; in which braided tufts of relatively fine monofilaments are placed in relationship with each other in such a manner that a well-balanced construction is permitted that would be strong enough to resist bursting forces which might be encountered in use; in which a high safety factor is obtained due to the well-balanced construction possibilities inherent in this braided type construction; and in which a design is obtainable that permits it to be used singly or in multiples, narrow or wide face, in any diameter that brushes might be required.

Another object of the invention is the provision of a brush which lends itself to further treatment, impregnation, or encapsulation.

SUMMARY OF THE INVENTION

In general, the invention consists of an industrial brush having a base which is adapted to be mounted for rotation and which has a plurality of filaments extending from the base. Each filament is in the form of a tube braided from strands of a synthetic resin, or the like.

More specifically, in the preferred embodiment the synthetic resin is polypropylene of a grade and strand size sufficient to give the filaments considerable stiffness. The braiding pattern is selected to provide suitable interstices for holding polishing compound. In one embodiment of the invention, the tube is provided with a central core consisting of a single solid strand of nylon in which fine abrasive particles have been embedded. In another embodiment of the invention the center of the tube is provided with a solid core of stiff steel wire.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
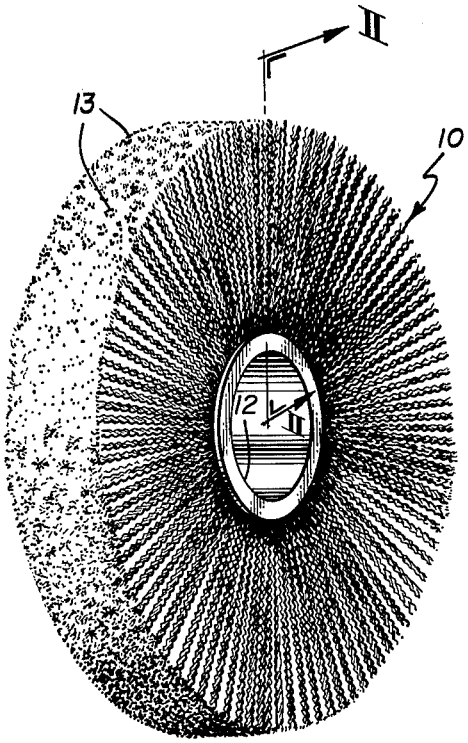
FIG. 1 is a perspective view of an industrial brush embodying the principles of the present invention.

Referring first to FIG. 1, wherein are best shown the general features of the invention, the industrial wheel, indicated generally by the reference numeral 10, is shown as having a base 11 through which extends a cylindrical bore 12. The bore is provided to permit the brush 10 to be mounted on a suitable shaft or spindle for rotation. Extending radially from the base 11 perpendicular to the axis of the bore 12 are a series of filaments 13 whose ends terminate on a cylindrical surface 14 concentric to the axis of the bore 12.

Figure 2:
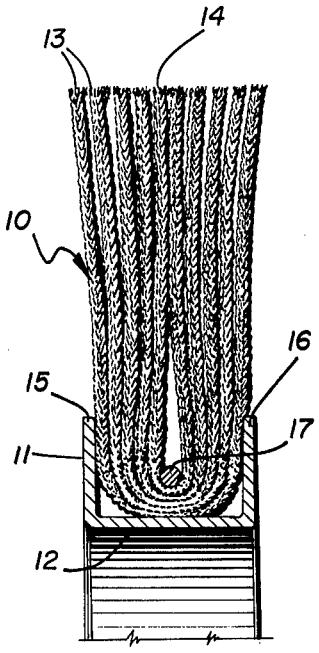
FIG. 2 is a sectional view of the industrial brush taken on the line II—II of FIG. 1.

Referring now to FIG. 2, it can be seen that each of the filaments 13 is U-shaped with the ends of its legs lying in the cylindrical surface 14, and its bight locked in the base 11. The base 11 has two spaced parallel flanges 15 and 16 which extend radially of the axis of the bore 12 and the inner portions or bights of the filaments 13 are locked between these two flanges by use of a ring 17. The flanges 15 and 16 are pressed inwardly against the body made up of the inner portions of the filaments, so that the filaments are locked securely in place. Their outer portions, however, are free to bend from the outer edges of the flanges radially outwardly.

Figure 3:
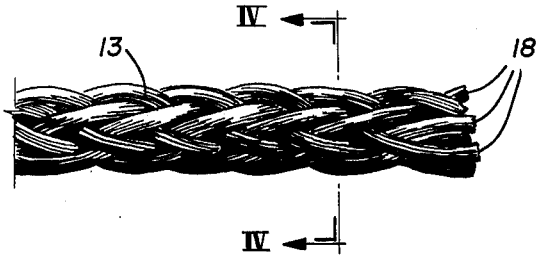
FIG. 3 is an enlarged perspective view of a single filament used in the wheel.
Figure 4:
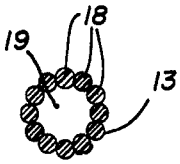
FIG. 4 is a sectional view of the filament taken on the line IV—IV of FIG. 3.

FIGS. 3 and 4 show the details of a filament 13. It can be seen that each filament is formed from a plurality of strands 18 which are braided together to form a tube having a central passage 19. It can be seen that the strands 18 at the outer end of the filament are unbraided and form a tassel or finely stranded brush of their own. The strands are formed from an artificial resin which, in the preferred embodiment, is polypropylene. The strands are selected of such a material and gage and the braiding pattern is selected in such a way that each filament has substantial stiffness, and yet porosity is provided by the interstices in the braid to hold liquid polishing compound and release it at a suitable time. The compound could also be of a more viscous character, such as varnish or grease.

Figure 5:
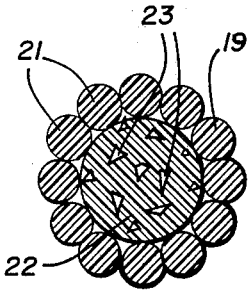
FIG. 5 is a sectional view of a modified form of the filament.

The operation of the invention will now be readily understood in view of the above description. The industrial brush 10, is mounted on a suitable rotatable shaft or spindle which extends through the bore 12. The brush is rotated and the workpiece which is to be polished is brought into contact with the ends of the filaments 13. The wheel is provided, either before or during the polishing operation, with a suitable compound. This may take the form of a liquid having very little viscosity for carrying very fine particles or abrasive, or detergent; it may be provided continuously to the brush, while the operation of polishing is being performed. Another manner of providing the polishing compound is to immerse the entire brush in a body of a non-drying varnish, and then sprinkling fine abrasive dust on the brush before use. The abrasive particles embed themselves in the varnish and are brought to bear against the workpiece which is to be polished. The varnish, on the other hand, is held in place by capillary attraction provided by the various fine passages and interstices in the braid and emerges onto the ends of the filaments by centrifugal force and the working of the strands in the braid. filaments FIG. 5 shows a variation in the construction of the filament. The modified filament 19 consists of a number of strands 21 of polypropylene which have been braided into a tube. Extending through the center of the tube and fitting tightly therein is a core 22, consisting of a strand of nylon in which have been embedded abrasive particles 23. The strand 23 is made by mixing the molten nylon with the abrasive particles and extruding it into a strand through a very hard nozzle. A nylon cord 23 serves two purposes in the filament. First of all, it makes the filament stiffer for use in those polishing situations where a rather stiffer filament is desirable. Secondly, it provides abrasive in addition to that provided in the polishing slurry itself. This version of the filament with its greater stiffness, due to the nylon core and because of the rather large abrasive particles embedded in that core, would be used for polishing operations where larger amounts of material are to be removed from the workpiece. The nylon wears away and exposes new abrasive grains. At the same time, the braided outer envelope provides the filament with great stiffness and wearability.

Figure 6:
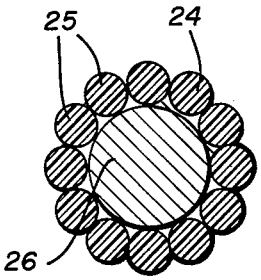
FIG. 6 is a sectional view of another modification of the filament.

In another form, the filament 24, shown in FIG. 6, consists of a number of polypropylene strands 25 which are braided to form a tube. Lying within the tube and tightly held thereby is a core 26 in the form of a wire strand. This wire strand consists of high-carbon steel which is particularly selected for this purpose. It is a steel which readily work-hardens at the ends and becomes hard and glass-like. This means that it cuts very well and, at the same time, is subject to breakage in such a way as to renew its cutting edge. In other words, as the polypropylene envelope wears away, the inner steel core is exposed to the working operation on the workpiece surface and assists in the cutting operation which is necessary for polishing. The sharp work-hardened edges of the steel core combine with the abrasive slurry carried in the braided envelope to provide a good polishing action.

The advantages of the present invention can be readily understood from the above description of the method of operation. The filament made by braiding synthetic resin into a tube provides the necessary stiffness for good polishing along with an ability to retain the polishing compound with which it has been impregnated. The size of the individual strands and the diameter of the tube, of course, determines to a great extent the nature of the filament and its particular adaptability to the polishing operation which is to be performed. In most respects it is similar to the filament formed from natural tampico. However, when a suitable synthetic resin is used, it is much tougher and longer wearing than tampico. In addition, it is possible to change its stiffness or its absorptive qualities to suit the needs of the operation which is to be performed. A looser braid in the tube provides greater storage capacity for abrasive slurry. A larger diameter tube and a larger diameter strand means a stiffer filament. In other words, not only is the present filament superior to tampico, but it is also readily available.

When a core is used with the braided tube of synthetic resin, even greater variation of the functional properties of the filament can be obtained. As has been stated above, selecting a filament of a certain characteristic, while selecting a nylon core with embedded abrasive particles will produce another type of operation. Here again, the selection of sizes and grades of steel, nylon, and abrasive particles can produce a filament which is exactly proper for a given polishing operation. In this respect it is superior to the vegetable fibers because such fibers offer only a limited variety of stiffness and absorptive qualities.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. An industrial brush, comprising:

a. a base having a central bore through which a spindle can pass for rotation of the base, and b. a plurality of generally cylindrical filaments with their axes extending radially from the base, each filament consisting of a tube braided from strands of a synthetic resin, a core extending through the center of the braided tube, the core being formed of nylon in which is embedded fine particles of abrasive.

2. An industrial brush as recited in claim 1, wherein the synthetic resin is polypropylene.

3. An industrial brush as recited in claim 1, wherein the filaments are impregnated with a treatment compound.

4. An industrial brush, comprising:

a. a base having a central bore through which a spindle can pass for rotation of the base, and b. a plurality of generally cylindrical filaments with their axes extending radially from the base, each filament consisting of a tube braided from strands of a synthetic resin, a core extending through the center of the braided tube, the core consisting of a steel wire wherein the steel is readily work-hardenable subject to continuous breaking during use to produce new sharp edges.

5. An industrial brush as recited in claim 4, wherein the synthetic resin is polypropylene.

6. An industrial brush as recited in claim 4, wherein the filaments are impregnated with a treatment compound.

* * * * *